US006412686B1

(12) United States Patent
Mahl et al.

(10) Patent No.: US 6,412,686 B1
(45) Date of Patent: Jul. 2, 2002

(54) THERMAL INSULATING SLEEVE FOR A CONTAINER

(75) Inventors: Robert R. Mahl, Cincinnati; James M. Newman, Loveland, both of OH (US)

(73) Assignee: Designmahl Ltd., Cincinnati, OH (US)

( * ) Notice: Subject to any disclaimer, the term of this patent is extended or adjusted under 35 U.S.C. 154(b) by 0 days.

(21) Appl. No.: 09/477,864

(22) Filed: Jan. 5, 2000

(51) Int. Cl.[7] ..... B65D 5/36

(52) U.S. Cl. ..... 229/108; 229/165; 229/178; 229/939; 220/738

(58) Field of Search ..... 229/108, 109, 229/110, 165, 178, 400, 405, 939; 220/737, 738, 739, 903

(56) References Cited

U.S. PATENT DOCUMENTS

| | | | | |
|---|---|---|---|---|
| 1,917,132 A | * | 7/1933 | Labombarde | 229/178 |
| 2,671,593 A | | 3/1954 | Page | 229/5.7 |
| 2,794,588 A | | 6/1957 | George et al. | |
| 2,807,405 A | | 9/1957 | Lambert | |
| 2,832,493 A | * | 4/1958 | Murphy | 220/903 |
| 3,727,824 A | * | 4/1973 | Giebel et al. | 229/165 |
| 3,768,720 A | | 10/1973 | Bundy | |
| 3,777,969 A | * | 12/1973 | Nurre | 229/178 |
| 3,937,392 A | | 2/1976 | Swisher | |
| 4,146,169 A | * | 3/1979 | Meyers et al. | 229/110 |
| 4,177,917 A | * | 12/1979 | Webinger | 229/110 |
| 4,398,650 A | | 8/1983 | Holmes et al. | |
| 4,993,580 A | | 2/1991 | Smith | |
| 5,222,656 A | | 6/1993 | Carlson | |
| 5,445,315 A | * | 8/1995 | Shelby | 220/903 |
| 5,492,269 A | | 2/1996 | Sung | 229/117.06 |
| 5,775,577 A | * | 7/1998 | Titus | 229/939 |
| 5,941,452 A | * | 8/1999 | Williams et al. | 229/109 |
| 6,026,983 A | * | 2/2000 | Graham | 229/110 |

FOREIGN PATENT DOCUMENTS

| | | | | |
|---|---|---|---|---|
| FR | 2591562 | * | 6/1987 | 229/165 |

OTHER PUBLICATIONS

The Wiley Encyclopedia of Packaging Technology, John Wiley & Sons, pp. 150, 557, (1986).*

* cited by examiner

*Primary Examiner*—Gary E. Elkins
(74) *Attorney, Agent, or Firm*—Mark F. Smith; Smith, Guttag & Bolin Ltd

(57) ABSTRACT

The present invention is directed to a thermal insulating sleeve for a container that is easily converted from a generally planar configuration during periods of nonuse and into an expanded or open configuration for receiving a container during periods of use. In a preferred embodiment of the invention, the thermal insulating sleeve comprises a plurality of side panels defining a generally tubular body positioned about an imaginary longitudinal axis having an open first end and a second end forming a central cavity therein. Circumferential positioned about the open first end and equally spaced one from another, is a plurality of fingers that extend generally radially inwardly into the central cavity and are angled generally downwardly with respect to the tubular body and are effective for stabilizing the container within the central cavity and for providing an insulating layer of air between the container and the tubular body. In a preferred embodiment of the invention, the thermal insulating sleeve further comprises a bottom.

20 Claims, 17 Drawing Sheets

THERMAL INSULATING SLEEVE FOR A CONTAINER

BACKGROUND OF THE INVENTION

The present invention is directed to a thermal insulating sleeve and more specifically, to a new and novel thermal insulating sleeve for insulating a container, such as a beverage container, that is easily converted from a relatively flat or planar configuration during periods of nonuse and into an open configuration for receiving a container during periods of use.

Thermal insulating sleeves, such as those used for insulating beverage containers, have been developed and are typically formed from polystyrene, expanded synthetic resins, or paper or cardboard material. While sleeves formed of polystyrene and expanded synthetic resins are aesthetically pleasing and provide good thermal insulation, they are not biodegradable or easily recyclable. Further, while such sleeves can generally be stacked or nested in an array, the resulting stack is generally bulky and often difficult to handle. Further, such sleeves cannot be stored or carried in a substantially planar configuration making them inconvenient for an individual to carry in a pocket, purse, and the like during periods of nonuse.

Thermal insulating sleeves formed from corrugated box board material have also been developed. Unfortunately, however, until now, such insulated sleeves are typically bulky and do not easily fold or collapse into a generally planar configuration for periods of nonuse. Further, it is often desirable for sleeves used for thermally insulating containers, such as beverage containers, to have an outer surface onto which advertising material can be printed. However, until now, the corrugated fluting associated with sleeves formed from corrugated box board material has resulted in printed material having a generally poor appearance.

Thermal insulating sleeves formed from polystyrene, expanded synthetic resins, or paper have also been designed to accommodate containers. Unfortunately, however, containers, such as used for beverages, vary slightly in size and sleeves that are properly sized to accommodate a particular size of beverage container are often not properly sized for accommodating a larger or a smaller size beverage container.

Accordingly, a need exist for a new and novel thermally insulating sleeve for a container, such as a beverage container, that can easily collapse into a substantially planar configuration during periods of nonuse and can be easily expanded into an open configuration for accommodating a container during periods of nonuse; is capable of accommodating containers of various sizes; is sturdy enough to withstand extensive handling; can be formed from a biodegradable and/or recyclable material; can be printed or embossed with printed images; is relatively inexpensive to manufacture; and is capable of being manufactured by existing machinery.

SUMMARY OF THE INVENTION

The present invention is directed to a thermal insulating sleeve for a container, such as a beverage container. In a preferred embodiment of the invention, the insulating sleeve comprises a plurality of side panels defining a generally tubular body positioned about an imaginary longitudinal axis. The tubular body includes an open first end and a second end forming a central cavity therein. Circumferential positioned about the open first end and equally spaced one from another, is a plurality of fingers that extend generally radially inwardly into the central cavity and are angled generally downwardly with respect to the tubular body.

In another preferred embodiment of the present invention, the thermal insulating sleeve is formed from a unitary blank that is appropriately folded to form the insulating sleeve. The blank includes a plurality of adjacent, generally rectangular, side portions connected together each having a top end, a bottom end, and a finger extending outwardly from the top end. The blank further includes an end panel and a flap. When the blank is formed into the thermal insulating sleeve, the end panel and the flap are secured together in an overlapping relationship to form a tubular body.

In another preferred embodiment of the present invention, the thermal insulating sleeve comprises a bottom.

In another preferred embodiment of the invention, the thermal insulating sleeve is formed from a unitary blank having first and second bottom closure flaps integral with and connected to the bottom ends of corresponding side portions and are connected together to form a bottom.

In another preferred embodiment of the invention, the bottom of the thermal insulating sleeve is formed without the use of an adhesive.

In another preferred embodiment of the present invention, the bottom of the thermal insulating sleeve is formed with the use of an adhesive.

In another preferred embodiment of the present invention, the thermal insulating sleeve may be expanded into an open configuration for receiving a container and may be collapsed into a closed or generally planar configuration for shipping, storage, carrying, or the like.

In another preferred embodiment of the present invention, the tubular body of the thermal insulating sleeve includes an exterior wall for receiving printed material.

In another preferred embodiment of the present invention, the tubular body of the thermal insulating sleeve includes an exterior wall having a printed laminate mounted thereon.

In another preferred embodiment of the present invention, the thermal insulating sleeve is formed from a material capable of being die cut and folded.

In another preferred embodiment of the present invention, the thermal insulating sleeve is formed of paperboard having an appropriate crush resistance.

In another preferred embodiment of the present invention, the thermal insulating sleeve is formed of a f or an E/F paperboard material.

In another preferred embodiment of the present invention, the thermal insulating sleeve is formed of a plastic material.

In another preferred embodiment of the present invention, the thermal insulating sleeve is formed of a transparent plastic material.

In another preferred embodiment of the present invention, the thermal insulating sleeve provides an insulating layer of air between the interior wall of the tubular body forming the thermal insulating sleeve and the container contained therein.

In another preferred embodiment of the present invention, the thermal insulating sleeve is formed from a foldable material selected from the group consisting of paper, paperboard, cardboard, box board, plastic, and foam.

A primary object of the present invention, therefore, is to provide a thermal insulating sleeve for a container that is easily converted from a collapsed or planar configuration during periods of nonuse and into an expanded or open configuration for receiving a container during periods of use.

Another primary object of the present invention is to provide a thermal insulating sleeve for a beverage container.

Another primary object of the present invention is to provide a thermal insulating sleeve for a container that reduces or eliminates condensation from forming along the outside of a relatively cold container contained therein.

Another primary object of the present invention is to provide a thermal insulating sleeve for a container which permits the container to be easily inserted into or out of the thermal insulating sleeve.

Another primary object of the present invention is to provide a thermal insulating sleeve that may easily accommodate various sizes of containers.

Another primary object of the present invention is to provide a thermal insulating sleeve for a container having a surface for displaying printed material.

Another primary object of the present invention is to provide a thermal insulating sleeve for a container that is capable of withstanding prolonged handling.

Another primary object of the present invention is to provide a thermal insulating sleeve for a container that is formed from biodegradable material.

Another primary object of the present invention is to provide a thermal insulating sleeve for a container that is formed from recyclable material.

Another primary object of the present invention is to provide a thermal insulating sleeve for a container that is relatively inexpensive to manufacture.

Another primary object of the present invention is to provide a thermal insulating sleeve for a container that can be manufactured using existing machinery.

These and other objects and advantages of the invention will be apparent from the following description, the accompanying drawings and the appended claims.

DETAILED DESCRIPTION OF THE PREFERRED EMBODIMENTS

Figure 1:
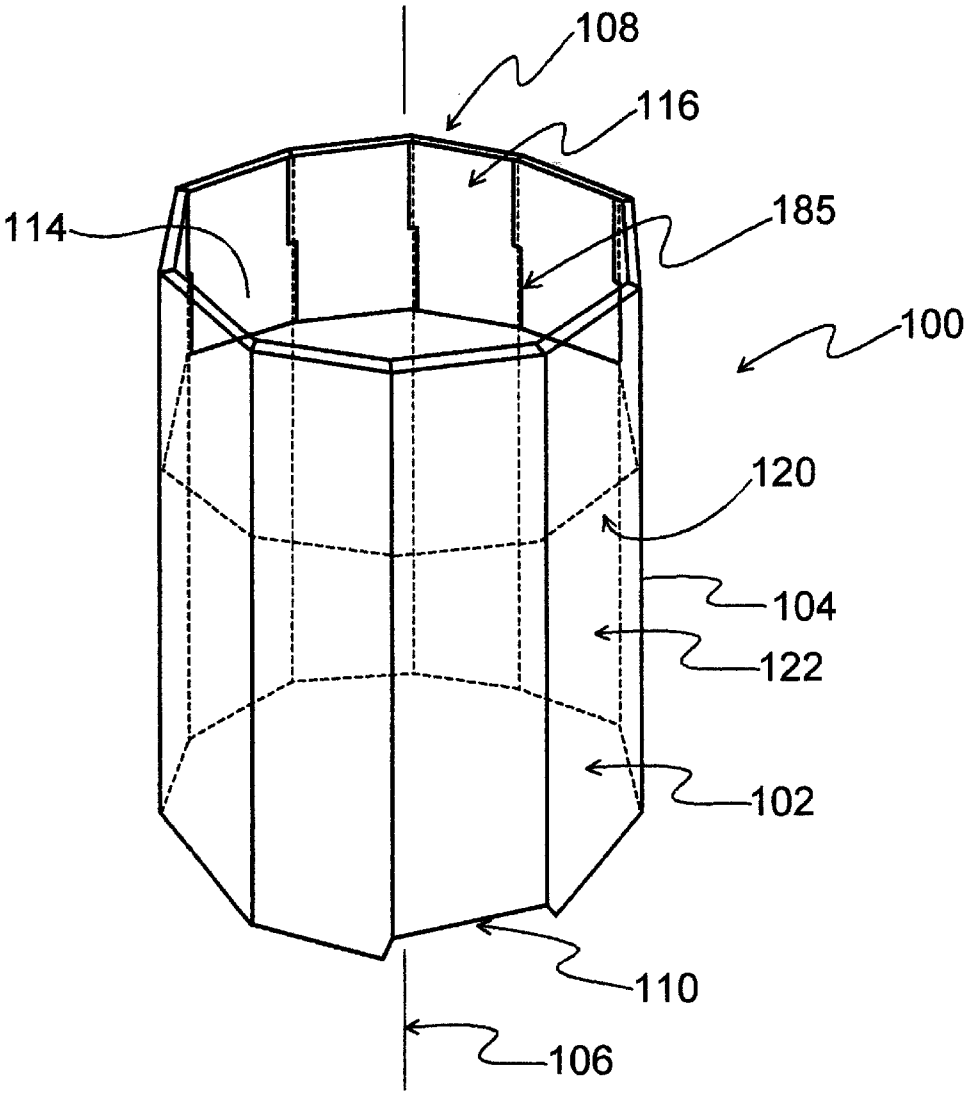
FIG. 1 is a perspective view of the fully assembled thermal insulating sleeve for a container in its expanded or open container receiving configuration.
Figure 5:
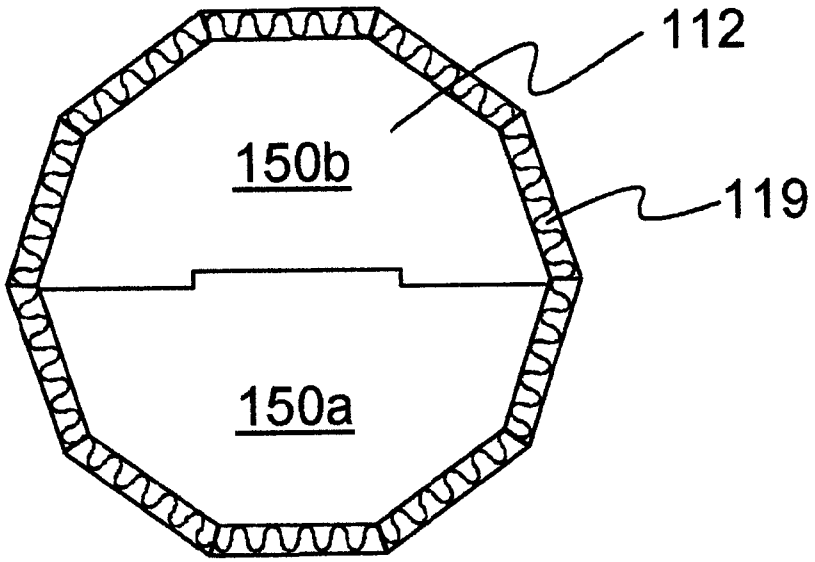
FIG. 5 is a bottom plan view showing the bottom of the thermal insulating sleeve formed from the blank of FIG. 2.
Figure 6:
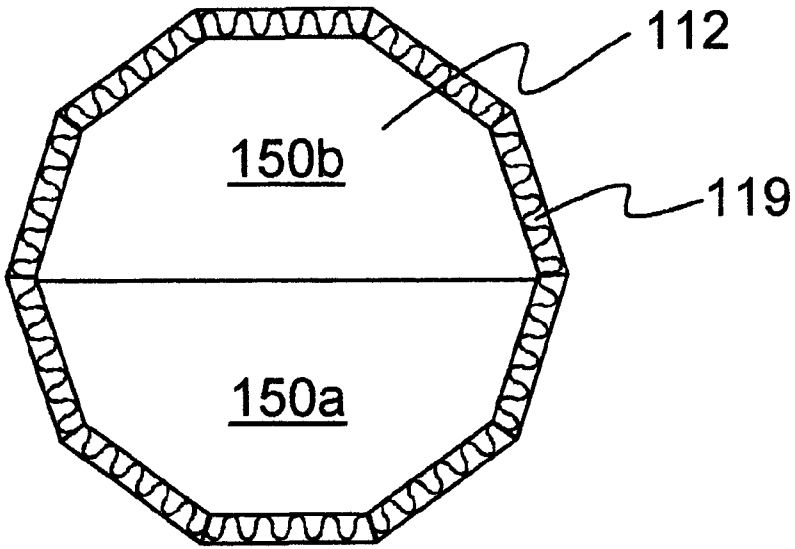
FIG. 6 is a bottom plan view showing the bottom of the thermal insulating sleeve formed from the blank of FIG. 4.
Figure 7:
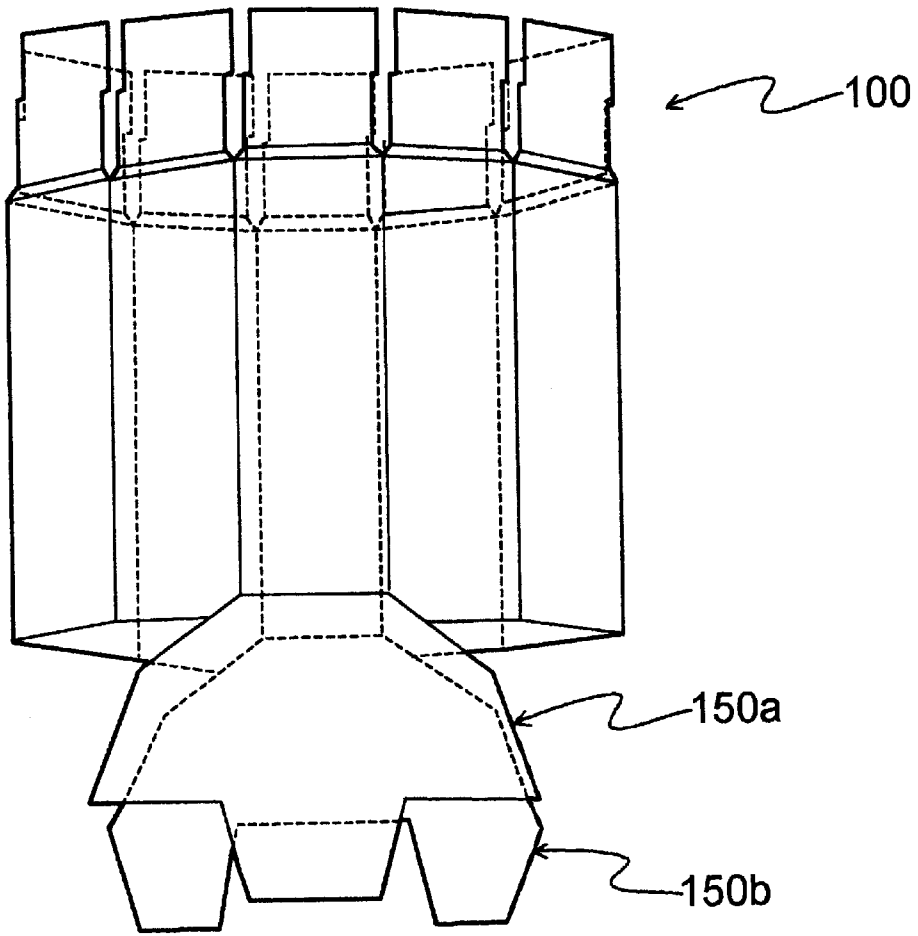
FIG. 7 is a perspective view of the blank of FIG. 2 folded to form the partially assembled thermal insulating sleeve of FIG. 1 showing the fingers, the first closure flap, and the second closure flap in a non-folded condition.

Referring to FIG. 1, a preferred embodiment of a thermal insulating sleeve for a container, generally designated 100, is shown in its expanded or open configuration for receiving a container. The thermal insulating sleeve 100 comprises a plurality of side panels 102 defining a generally tubular body 104, positioned about an imaginary longitudinal axis 106, having an open first end 108 and a second end 110 forming a central cavity 114 therein. In a preferred embodiment of the invention, the insulating sleeve 100 further comprises a bottom 112 (FIGS. 5 and 6). Circumferential positioned about the open first end 108 and equally spaced one from another, is a plurality of fingers 116 that extend generally radially inwardly into the central cavity 114 and are angled generally downwardly with respect to the tubular body 104. As used herein, the terms "inward" or "inwardly" correspond to the direction towards the imaginary longitudinal axis 106, and the terms "outward" or "outwardly" correspond to the direction away from the imaginary longitudinal axis 106. As used herein, the terms "upward" or "upwardly" correspond to the direction longitudinally towards the open first end 108 of the tubular body 104, and the terms "downward" or "downwardly" correspond to the direction longitudinally towards the second end 110 of the tubular body 104.

Figure 2:
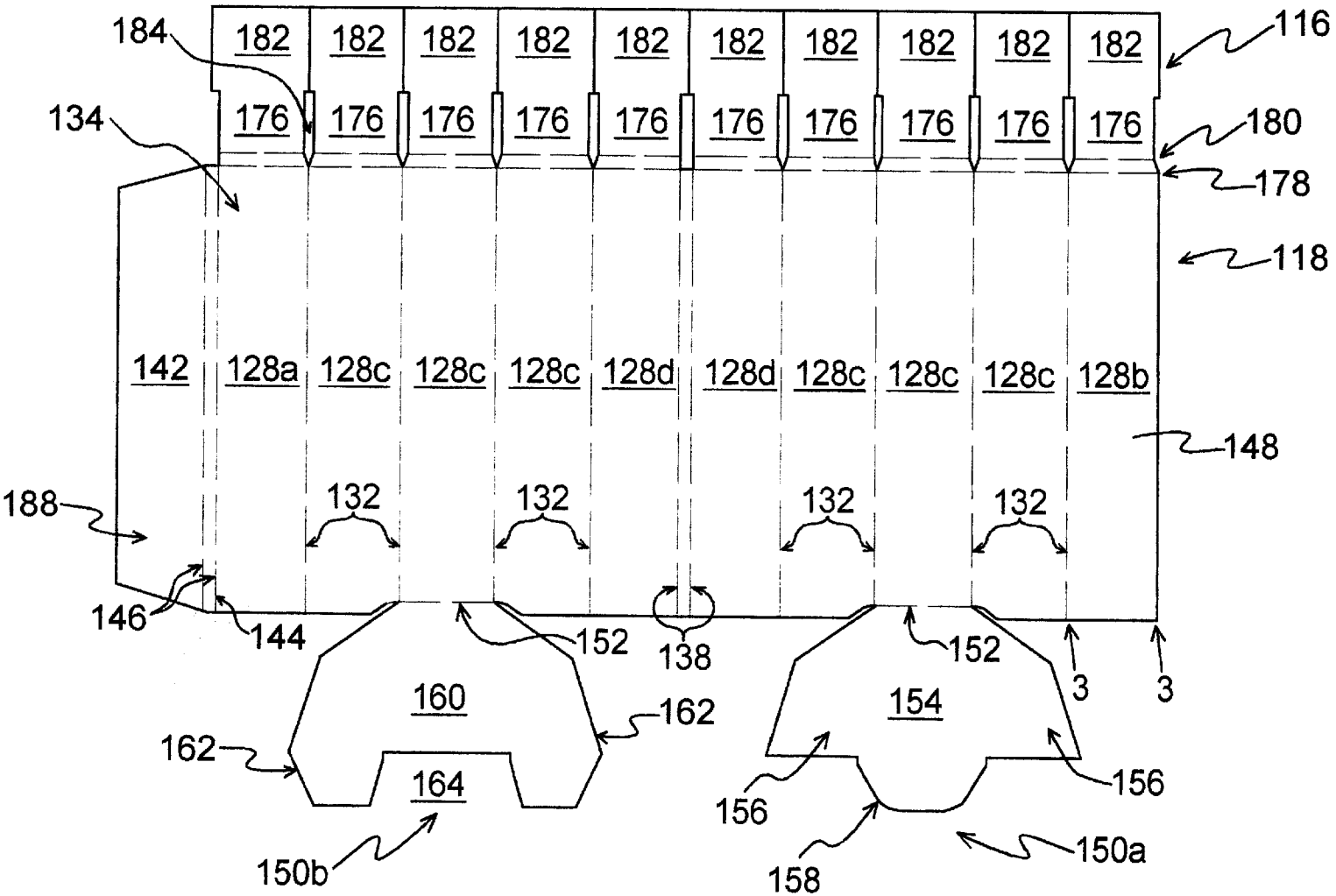
FIG. 2 is a plan view of a preferred embodiment of a blank which can be formed into the thermal insulating sleeve for a container of the present invention having a bottom formed without the use of an adhesive.
Figure 3:
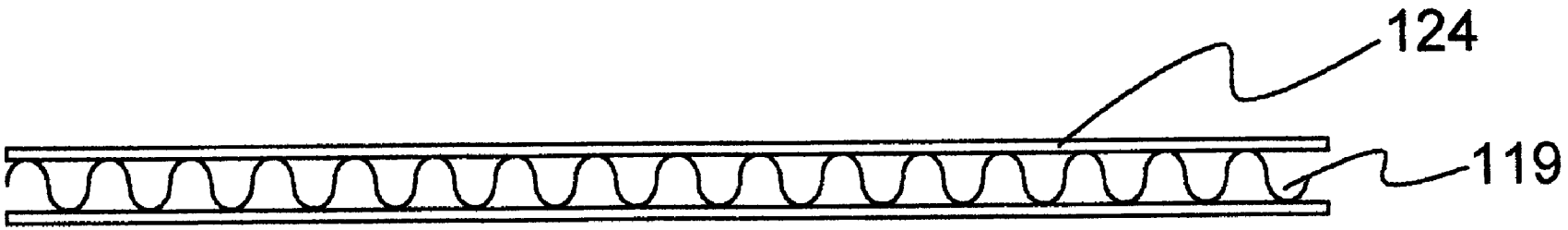
FIG. 3 is a fragmentary sectional view of the thermal insulating sleeve of FIG. 1 taken at 3—3 thereof having a laminate, such as a lithography printed paper, mounted thereon.
Figure 4:
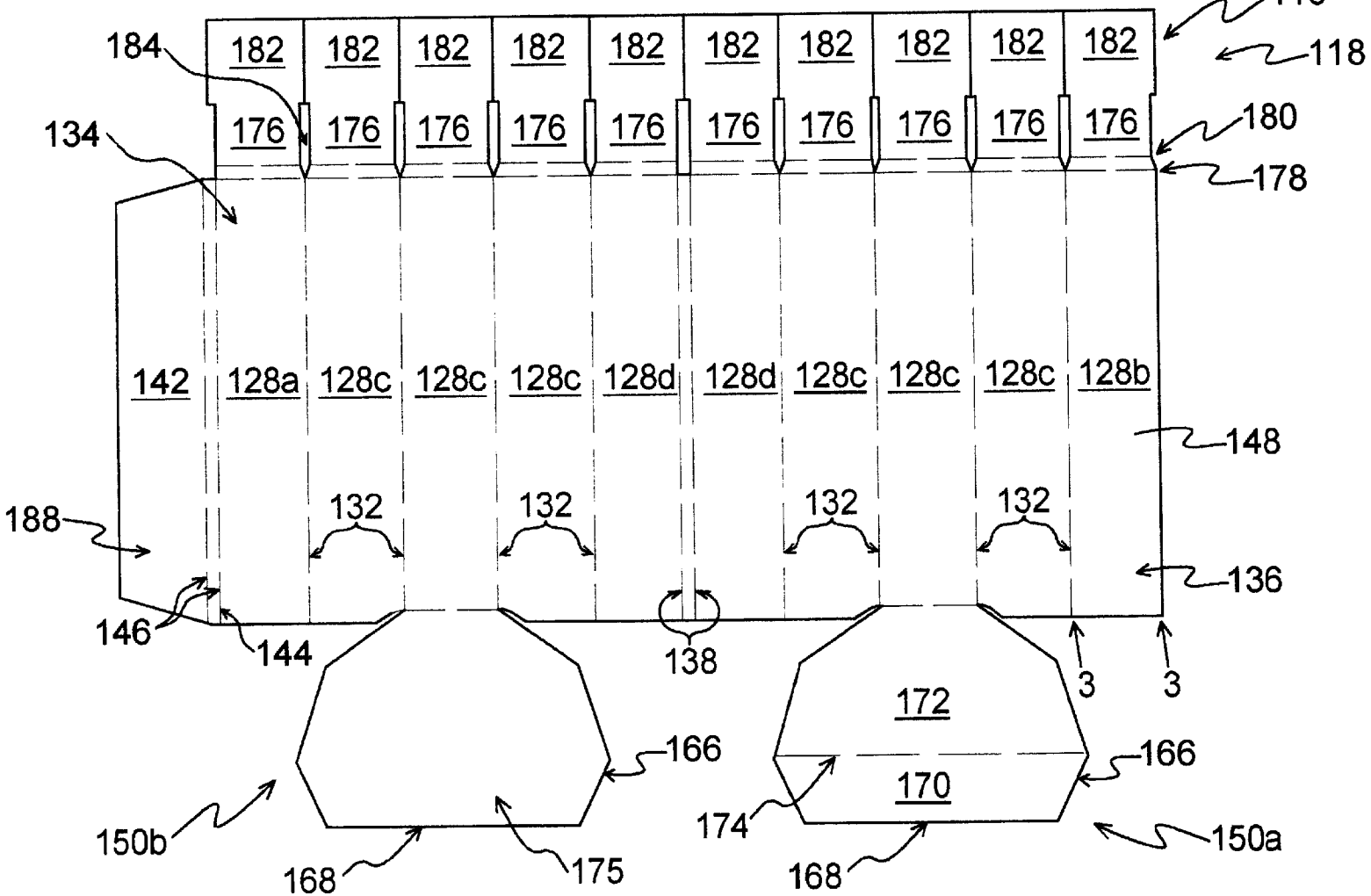
FIG. 4 is a plan view of another preferred embodiment of a blank which can be formed into the thermal insulating sleeve for a container of the present invention having a bottom formed with the use of an adhesive.
Figure 15:
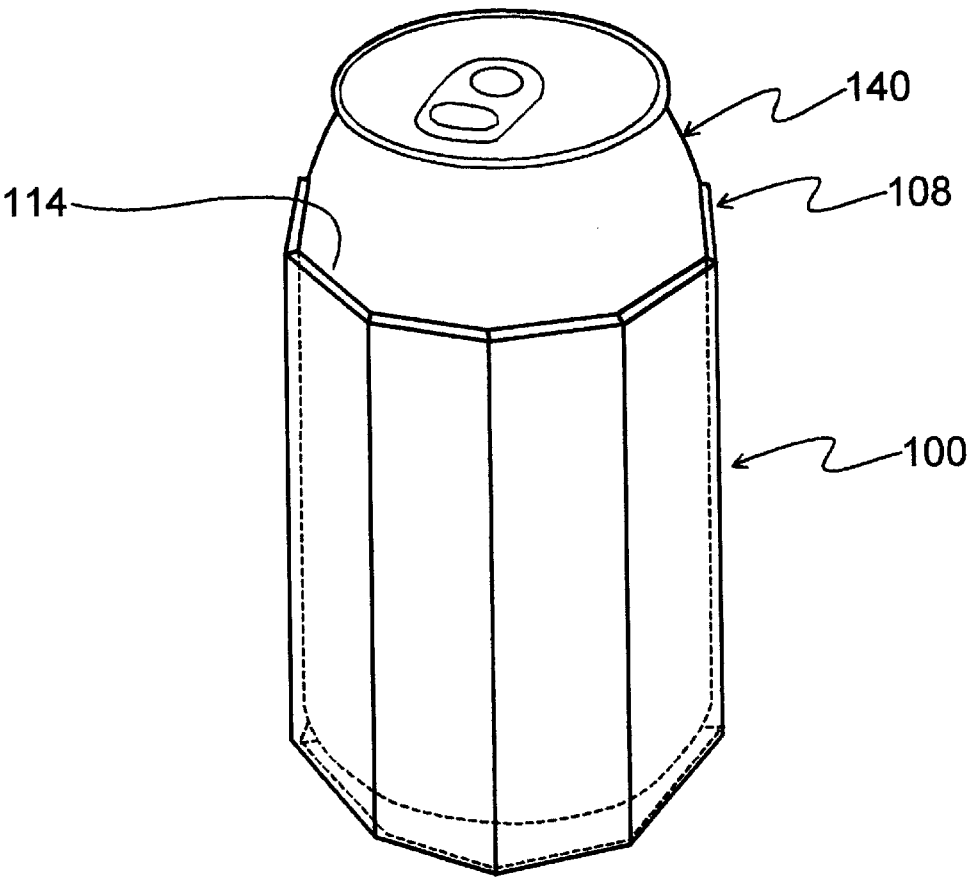
FIG. 15 is a perspective view of the thermal insulating sleeve of FIG. 1 showing a container received therein.

Referring to FIGS. 1, 2 and 4, a preferred embodiment of the thermal insulating sleeve 100 is shown before the assembly thereof The sleeve 100 is preferably formed from a unitary blank 118 of paperboard of an appropriate crush resistance, preferably having a 150-pound burst rating of F or E/F paperboard material, such that an array of generally longitudinally extending fluted corrugating 119 (FIGS. 5 and 6) is positioned between the interior wall 120 and the exterior wall 122 of the tubular body 104 (FIG. 1). The use of a corrugated material provides strength as well as providing a plurality of thermally insulating air spaces between the interior wall 120 and the exterior wall 122 of the tubular body 104. However, it should be understood that other suitable materials, such as other forms of paper, various plastics, foams, fabrics, and other materials capable of being die-cut and folded into shape may also be used. In a preferred embodiment of the invention, the blank 118 may be imprinted or embossed with advertising material, graphics, and the like, such that the material is displayed on the exterior wall 122 when the blank 118 is formed into the insulating sleeve 100 (FIG. 15). In another preferred embodiment of the invention, the blank 118 includes a laminate 124 (FIG. 3), such as a lithography printed paper, mounted thereon by an appropriate adhesive, such that when the blank 118 is formed into the thermal insulating sleeve 100, the lithography printed paper is displayed outwardly showing the printed matter thereon. It has been found that unlike conventional insulating sleeves for containers that are formed from corrugated box material, forming the blank 118 from a F or E/F paperboard material permits lithography printed paper displaying photo-realistic images to have a relatively smooth and attractive appearance. It should now be apparent to those skilled in the art that forming the thermal insulating sleeve 100 from a transparent plastic will permit the container and any printed material contained thereon to be viewed while providing thermal insulation for the container.

Figure 17:
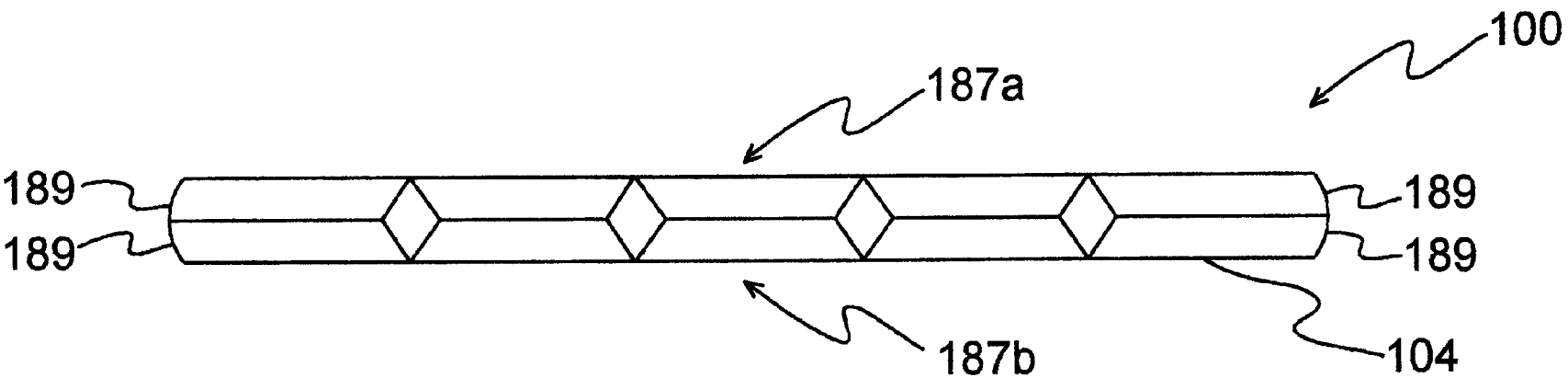
FIG. 17 is a top view of the thermal insulating sleeve of FIG. 1 in its collapsed generally planar configuration.

The blank 118 includes a plurality of adjacent, generally rectangular outer side portions 128*a* and 128*b*, inner side portions 128*c* and center side portions 128*d* connected together along longitudinally extending fold lines 132, and each having a top end 134 and a bottom end 136. Center side portions 128*d* are connected together along a pair of generally parallel, longitudinally extending fold lines 138. When assembled, side portions 128*a*, 128*b*, 128*c* and center side portions 128*d* form the side panels 102 of the tubular body 104 for enclosing a container 140 (FIG. 15). In a preferred embodiment of the invention, as shown in the drawings, the blank 118 includes ten side portions 128*a*, 128*b*, 128*c* resulting in the thermal insulating sleeve 100 having a decahedron cross section (FIGS. 5 and 6). It has been found that a thermal insulating sleeve 100 for a container, such as a hand-held beverage container, having such a cross section is relatively comfortable to hold and permits the thermal insulating sleeve 100 to be easily collapsed into a planar configuration (FIG. 17) during periods of nonuse. It should now be apparent, however, to those skilled in the art that the thermal insulating sleeve 100 of the present invention may be easily formed having other geometric cross sections by simply increasing or decreasing the number of inner side portions 128*c* comprising blank 118. It should also now be apparent to those skilled in the art that when increasing or decreasing the number of inner side portions 128*c*, an equal number of side portions 128*c* should be maintained on each side of the center side portions 128*c* to permit the thermal insulating sleeve 100 to collapse into a generally symmetric planar configuration (FIG. 17).

The blank 118 further comprises an integral flap 142 attached to the outer edge 144 of the outer side portion 128*a* along a pair of generally parallel, longitudinally extending fold lines 146. The flap 142 is effective for overlapping and attaching to the opposite surface 148 of the outer side portion 128*b* when the blank 118 is formed into the tubular body 104.

As shown in FIGS. 2 and 4, fingers 116 each include a lower portion 176 attached to the top end 134 of a corresponding side portion 128*a*, 128*b* and 128*c* along transverse fold lines 178, 180, and an upper portion 182 integral with the lower portion 176. Each finger 116 is separated from the lower portion 176 of an adjacent finger 116 by a slot 184.

Referring to FIGS. 1, 2 and 4, in order to assemble the thermal insulating sleeve 100 of the present invention, the blank 118 is first folded along fold lines 132 and 138 to define the side panels 102. An adhesive, such as a glue, contact cement, or any other conventional means, is applied to a first surface 188 of flap 142. After the adhesive is applied, the flap 142 is placed into overlapping relation with the opposite surface 148 of the outer side portion 128*b* and are bonded together thereby forming the tubular body 102.

In one embodiment of the invention, as shown in FIG. 2, the blank further includes first and second bottom closure flaps, 150*a* and 150*b*, respectively, integral with and extending outwardly from bottom ends 136 of corresponding inner side portions 128*c* along transverse fold lines 152. The first bottom closure flap 150*a* includes a generally rectangular body 154 having wings 156 and an outwardly longitudinally extending locking flap 158. The second bottom closure flap 150*b* also includes a generally rectangular body 160 having wings 162 which cooperate to form a cutout section 164. The wings 156 and 162 are configured such that when the insulating sleeve 100 is assembled, as herein described, the first and second bottom closure flaps 150*a*, 150*b* cooperate to form the bottom 112 having the same cross section as the tubular body 104 (FIG. 5).

Figure 8:
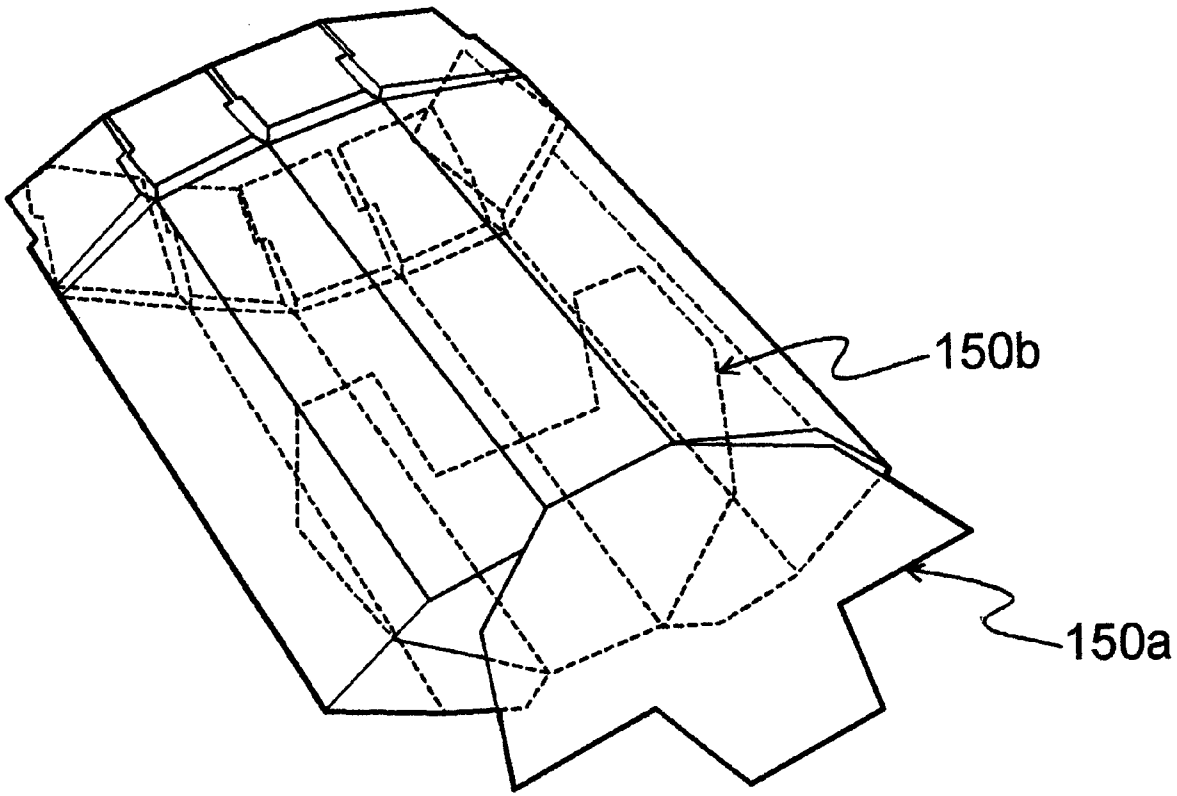
FIG. 8 is a perspective view of the blank of FIG. 2 folded to form the partially assembled thermal insulating sleeve of FIG. 1 showing the second closure flap folded inwardly.
Figure 9:
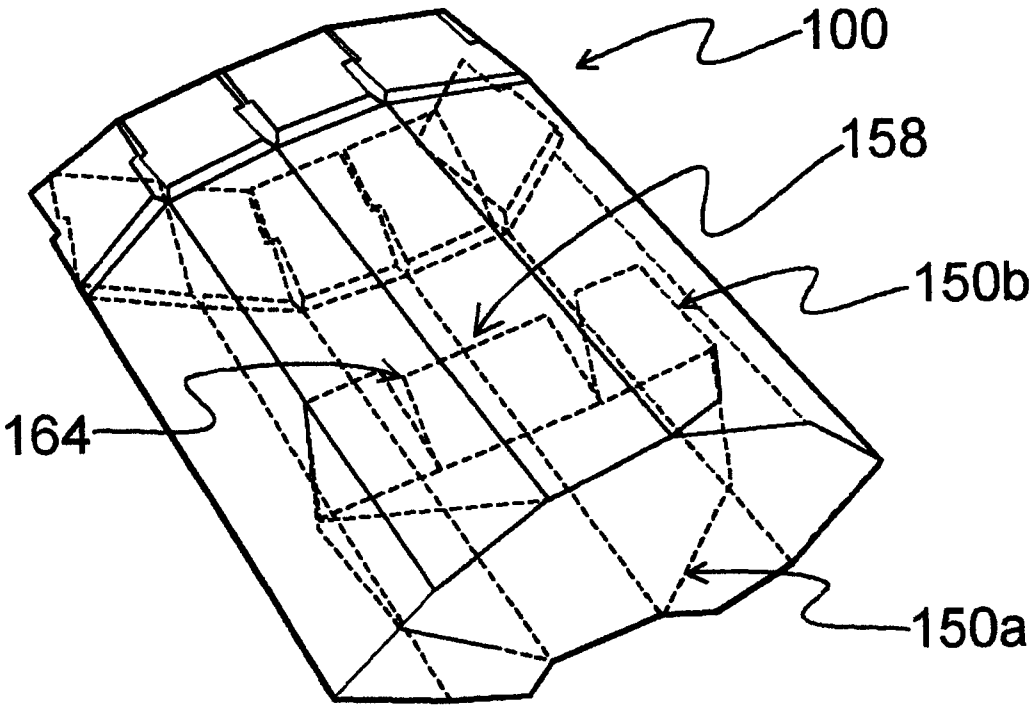
FIG. 9 is a perspective view of the blank of FIG. 2 folded to form the partially assembled thermal insulating sleeve of FIG. 1 showing the second closure flap and the first closure flap folded inwardly into an overlapping relationship to form a bottom.
Figure 10:
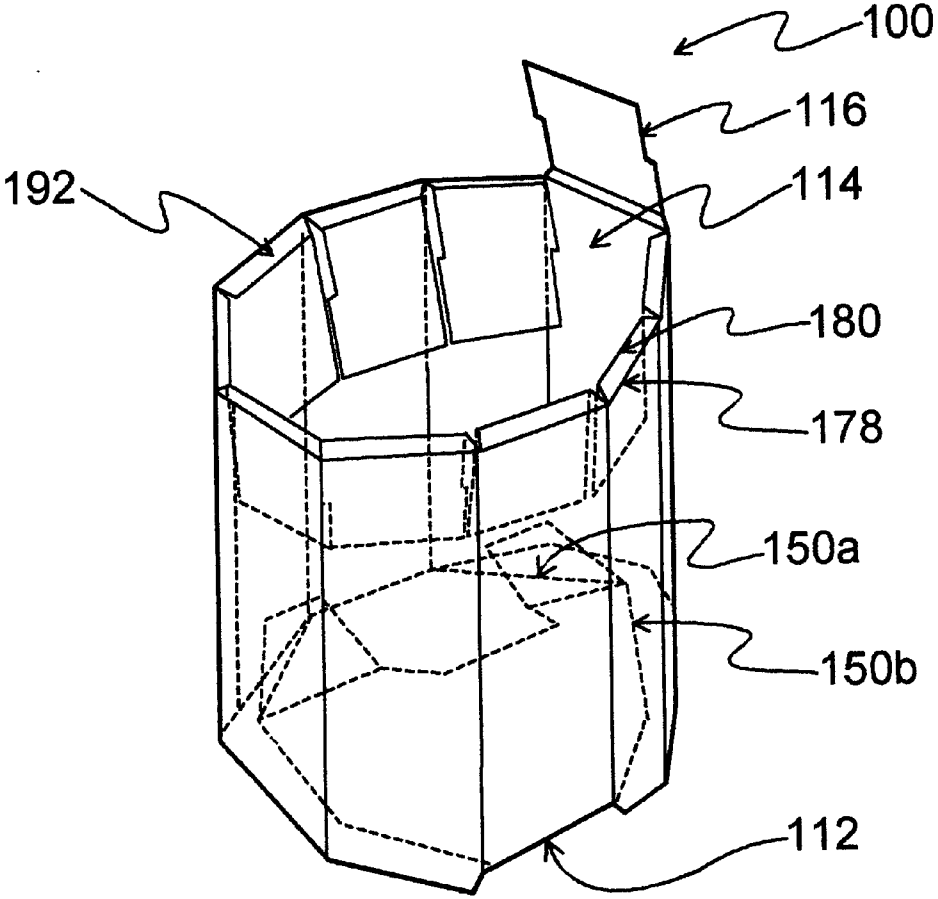
FIG. 10 is a perspective view of the blank of FIG. 2 folded to form the partially assembled thermal insulating sleeve of FIG. 1 showing some of the fingers folded inwardly into the central cavity and the first closure flap and the second closure flap folded in an overlapping relationship to form a bottom.
Figure 11:
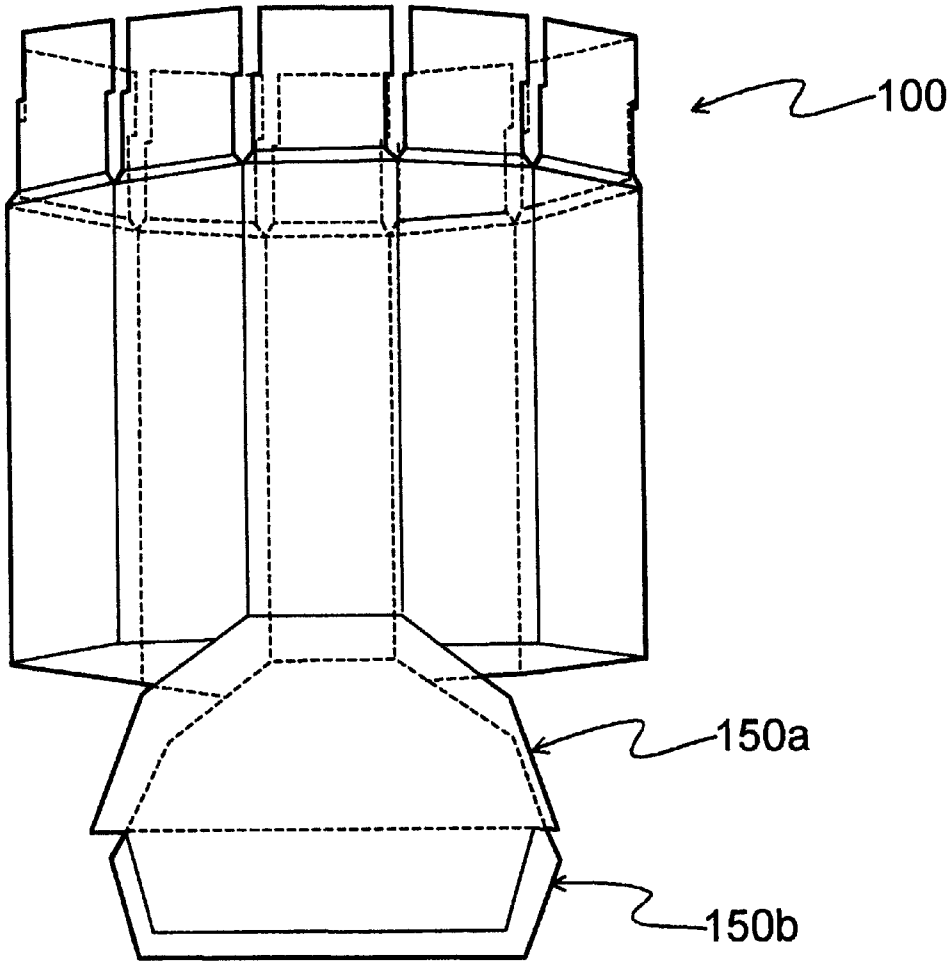
FIG. 11 is a perspective view of the blank of FIG. 4 folded to form the partially assembled thermal insulating sleeve of FIG. 1 showing the fingers, the first closure flap, and the second closure flap in a non-folded condition.
Figure 12:
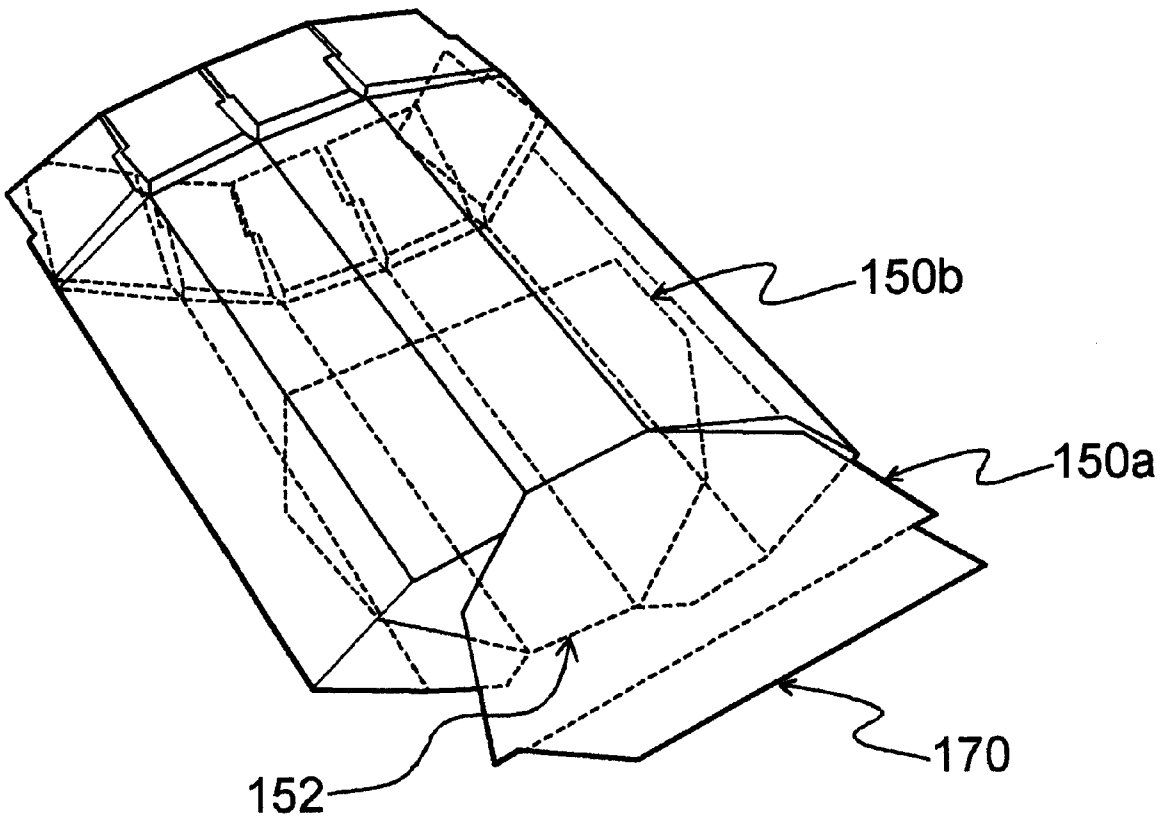
FIG. 12 is a perspective view of the blank of FIG. 4 folded to form the partially assembled thermal insulating sleeve of FIG. 1 showing the second closure flap folded inwardly.
Figure 13:
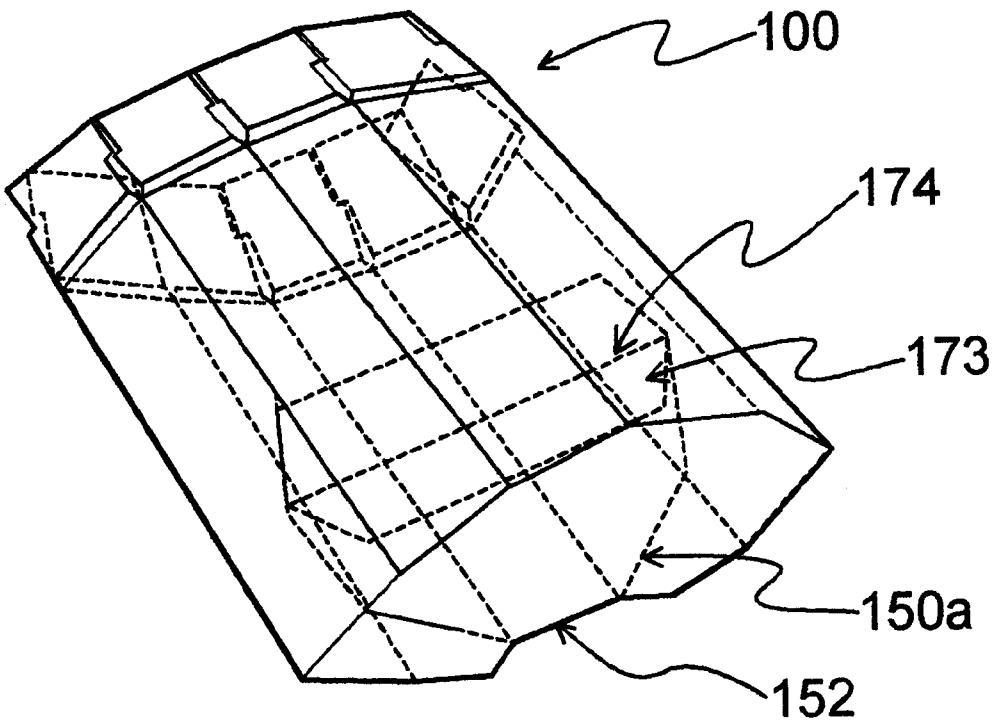
FIG. 13 is a perspective view of the blank of FIG. 4 folded to form the partially assembled thermal insulating sleeve of FIG. 1 showing the second closure flap and the first closure flap folded inwardly into an overlapping relationship to form a bottom.

As shown in FIGS. 2, 5, and 7 through 10, after the flap 142 is secured to the opposite surface 148 of the outer side portion 128*b* (FIG. 7), the second bottom closure flap 150*a* is first folded inwardly (FIG. 8). Then the first bottom closure flap 150*a* is folded inwardly such that the locking flap 158 of the first bottom closure flap 150*a* conventionally slips through the cut out section 164 of the second bottom closure flap 150*b* (FIG. 9). The first closure flap 150*a* and the second closure flap 150*b* are then slidably locked together (FIG. 10) and may be urged downwardly, such as by the insertion of a container into the central cavity 114 of the thermal insulating sleeve 100. It should now be apparent to those skilled in the art that the bottom 112 provides a bottom 112 formed without requiring the use of an adhesive. It should also now be apparent to those skilled in the art that by slidably locking the first closure flap 150*a* and the second closure flap 150*b*, permits the thermal insulating sleeve 100 to collapse into a generally planar configuration (FIG. 17). As shown in FIG. 10, fingers 116 are then folded inwardly along fold line 178 and downwardly into the central cavity 114 along fold line 180 thereby defining an upper edge 192 or lip of the insulating sleeve 100.

Figure 14:
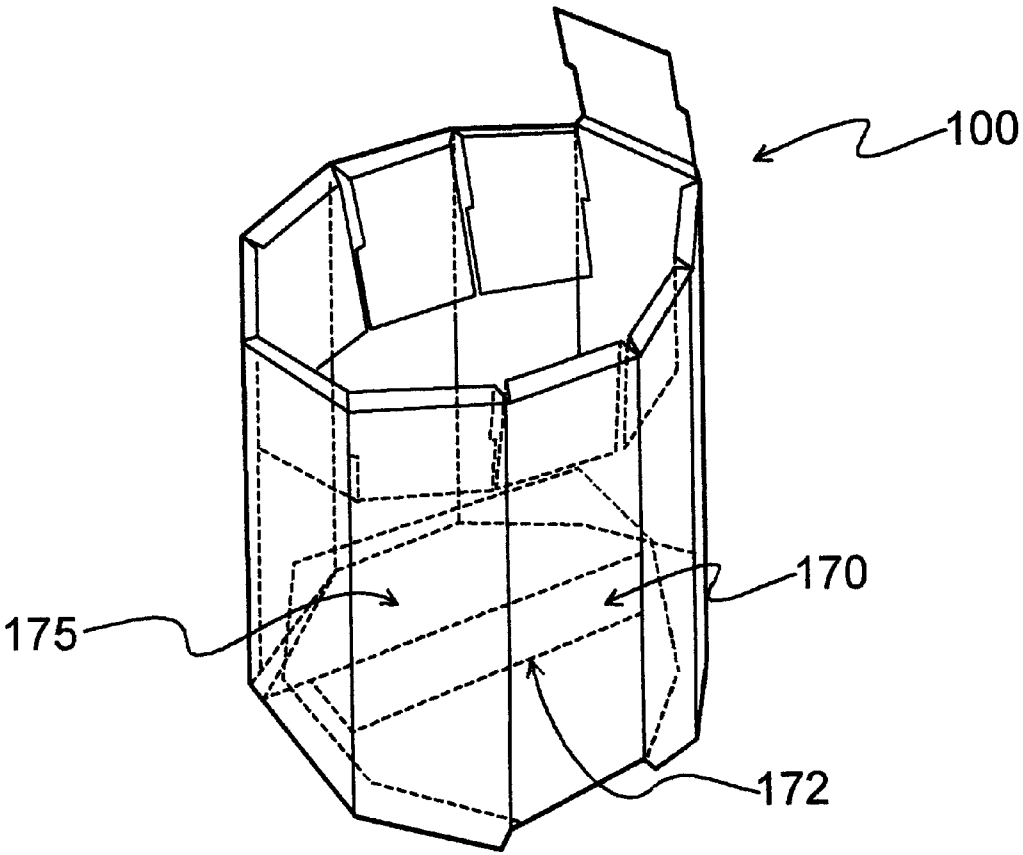
FIG. 14 is a perspective view of the blank of FIG. 4 folded to form the partially assembled thermal insulating sleeve of FIG. 1 showing some of the fingers folded inwardly into the central cavity and the first closure flap and the second closure flap folded in an overlapping relationship to form a bottom.

In another preferred embodiment of the invention, as shown in FIGS. 4, 6, and 11 through 14, the first and second bottom closure flaps, 150*a* and 150*b*, respectively, are formed such as each have peripheral edges 166 are substantially equal in length and have a substantially longer outer edge 168. When the thermal insulating sleeve 100 is assembled, as herein described, the first and second bottom closure flaps 150*a*, 150*b* cooperate to form the bottom 112 having the same cross section as the tubular body 104. As shown, the first bottom closure flap 150*a* further includes a outer segment 170 and an inner segment 172 defined by scored line 174. As shown in FIGS. 4, 6, and 11 through 14, after the flap 142 is secured to the opposite surface 148 of the outer side portion 128*b* (FIG. 11), the bottom 112 is formed by folding the second bottom closure flap 150*b* inwardly (FIG. 12) along fold line 152 and applying an adhesive to the downwardly facing surface 170 of the first bottom closure flap 150*a*. After the adhesive is applied, the first bottom closure flap 150*a* is folded inwardly along fold line 152 (FIG. 13) and along scored line 174 such that the upwardly facing surface 173 of outer segment 170 of the first bottom closure flap 150*a* is placed into overlapping relation with the downwardly facing surface 175 of the second bottom closure flap 150*b* and are bonded together to form bottom 112 (FIG. 14). It has been found that the use of a bottom 112 formed using an adhesive as hereby described provides a relatively stronger bottom than bottoms formed without the use of an adhesive or other such means. It should now be apparent to those skilled in the art that while the bottoms disclosed herein are the preferred embodiments, other forms of bottoms that permit the thermal insulating sleeve to expand into an open configuration and collaps into a generally planar configuration may also be used.

Figure 16:
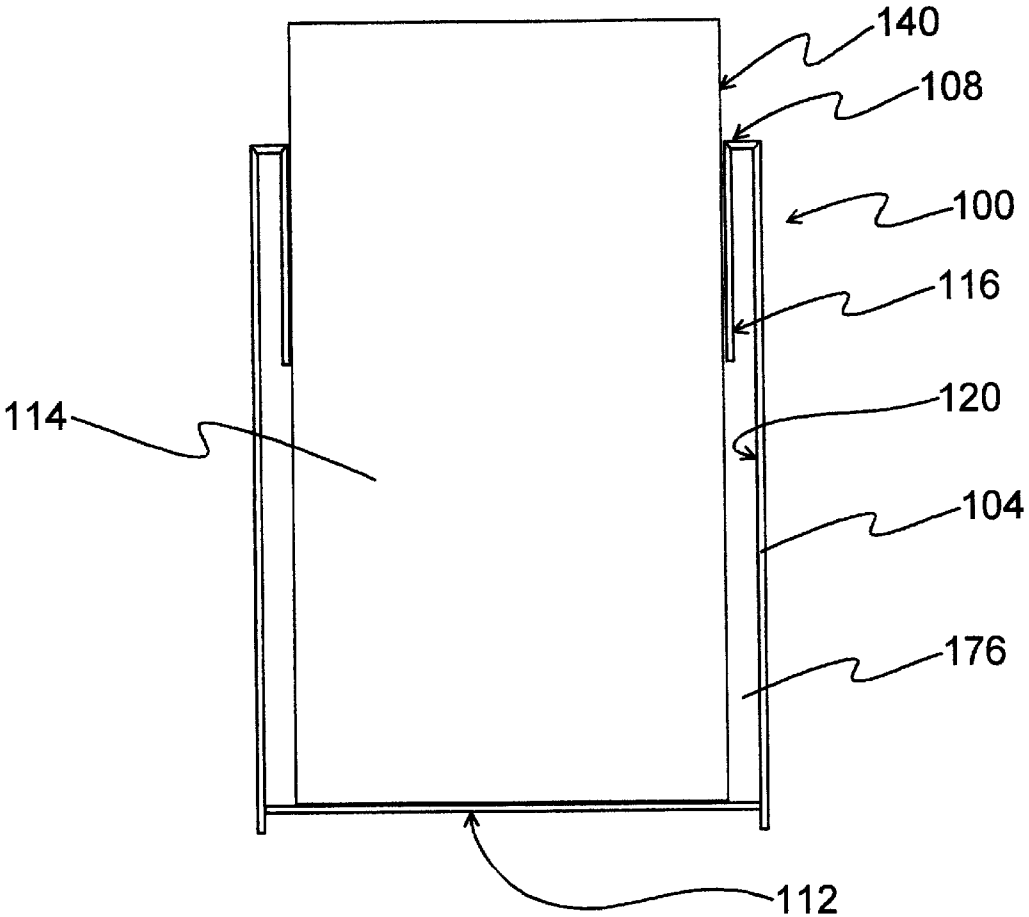
FIG. 16 is a longitudinal sectional view of the thermal insulating sleeve of FIG. 11 as taken at 16—16 thereof.

As shown in FIG. 15, after the thermal insulating sleeve 100 is formed utilizing the blank shown in either FIG. 2 or FIG. 4, a container 140, such as a beverage container, can be easily inserted through the open first end 108 and received within the central cavity 114 of the thermal insulating sleeve 100. As shown in FIGS. 15 and 16, fingers 116 operate to effectively stabilize the container 140 and to space the container 140 from the interior wall 120 of the tubular body 104 so as to provide an insulating layer of air 176 between the beverage container 140 and the tubular member 104. It should now be apparent to those skilled in the art that by providing an insulating layer of air 176 between the interior wall 120 of the tubular body 104 and the container 140 provides relatively good insulation for maintaining the temperature of the material within the container. It has been found that such insulating layer of air 176 will also operate to reduce or eliminate condensation that forms and accumulates along the surface of a relatively cold container 140 that may contact the inner wall 120 of the tubular body 104 thereby reducing its structural integrity or may drip out through the tubular body 104. It should also now be apparent to those skilled in the art that by providing the thermal insulating sleeve 100 with a bottom 112 also prevents or hinders any such condensation from dripping out through the tubular body 104 thereby operating as a coaster for protecting surfaces such as the surface of furniture. It has also been found that by folding fingers 116 along fold lines 178 and 180 (FIGS. 2 and 4) provide the fingers 116 with flexibility thereby permitting the insulating sleeve 100 to easily accommodate relatively slight variations in the size of the container 140. Further, as shown in FIG. 2 and 4, slot 184 provides each finger 116 with a tab 185 (FIG. 1) such that when fingers 116 are folded radially inwardly, each tab 178 is placed into an overlapping relationship with an adjacent finger 116. Such overlapping relationship operates to urge each finger 116 outwardly away from the interior wall 120 of the of the tubular body 104. Such outwardly urging of fingers 116 serves to further stabilize the beverage container 140 withing the central cavity 114 in spaced relationship from the internal wall 120 of the tubular body 104. Further, as shown in FIG. 15, in order to permit the user to easily remove the container 140, in a preferred embodiment of the invention, the thermal insulating sleeve 100 is longitudinally sized to permit a portion of the container 140 to extend outwardly from the open first end 108.

Referring to FIGS. 1, 2, 4, and 17, the thermal insulating sleeve for a container 100 is shown in its collapsed or generally planar configuration for periods of nonuse. To collapse the insulating sleeve 100, the tubular body 104 is pressed inwardly in a direction towards the imaginary longitudinal axis 106 to bend the tubular body 104 along longitudinal fold lines 128*a*, 128*b*, 128*c* forming the individual side panels 102 thereby creating two generally planar halves 187*a*, 187*b*. It should now be apparent to those skilled in the art that the use of parallel, longitudinally extending fold lines 138, as shown, significantly reduces the fold angle 189 between the center side portions 128*d* thereby significantly increasing the cycle life (amount number of times the insulating sleeve is cycles between an open configuration for receiving a container and into a collapsed generally planar configuration) of the thermal insulating sleeve 100.

Referring to the thermal insulating sleeve 100 formed from the blank 118 shown in FIG. 2, simultaneously with the bending of the tubular body 104 as described above, the first bottom closure flap 150*a* and the second bottom closure flap 150*b* rotate inwardly along traverse fold line 152 thereby sliding the locking flap 158 through the cut out section 164 such that the first bottom closure flap 150*a* and the second bottom closure flap 150*b* are rotated into a substantially parallel position relative to the interior wall 120 (FIG. 1) of the tubular body 104.

Referring to the thermal insulating sleeve 100 formed from the blank 118 shown in FIG. 4, simultaneously with the bending of the tubular body 104 as described above, the first bottom closure flap 150*a* and the second bottom closure flap 150*b* rotate inwardly along fold line 152. Scored line 174 operates as a hinge thereby permitting the first bottom closure flap 150*a* and the second bottom closure flap 150*b* to rotate into a substantially parallel position relative to the interior wall 120 (FIG. 1) of the tubular body 104.

It should now be apparent to those skilled in the art that once the thermal insulating sleeve 100 for a container is collapsed into a generally planar configuration, it can be easily carried, packaged, stacked, or stored for periods of nonuse.

It should also now be apparent to those skilled in the art that the above described invention provides a novel thermal insulating sleeve for a container that can be easily collapsed into a generally planar configuration during periods of nonuse and can be easily expanded into an open configuration for accommodating a container; is capable of accommodating various sizes of containers; is sturdy enough to withstand extensive handling; can be formed from a biodegradable and/or a recyclable material; can be printed or embossed with printed images; is relatively inexpensive to manufacture; and is capable of being manufactured by existing machinery. It should also now be apparent to those skilled in the art that the thermal insulating sleeve may be easily sized for use with various types of containers, such as for use with conventional 8 ounce beverage containers, kegs and cask typically used for beverages, bottles for wine or soft drinks, and other containers requiring a thermal insulating sleeve.

Although this invention has been shown and described with respect to detailed embodiments thereof, it will be understood by those skilled in the art that various changes in form and detail thereof may be made without departing from the spirit and scope of the claimed invention.

What is claimed is:

1. A thermal insulating sleeve comprising:

a plurality of side panels defining a tubular body positioned about an imaginary longitudinal axis and having an open end and a second end forming a central cavity therein;

a plurality of flexible fingers positioned about said open end and extending generally downwardly into said central cavity, said fingers are operable to stabilize the container within said cavity away from said tubular body.

2. The thermal insulating sleeve of claim 1 further comprising a bottom.

3. The thermal insulating sleeve of claim 1 wherein said fingers each include a tab effective for placing said fingers in an overlapping relationship with one another.

4. The thermal insulating sleeve of claim 1 wherein said sleeve having an open configuration for receiving a container and a generally planar configuration for periods of non-use.

5. The thermal insulating sleeve of claim 1 wherein said sleeve is formed from a material capable of being die-cut and folded into a desired shape.

6. The thermal insulating sleeve of claim 1 wherein said sleeve has a decahedron cross section.

7. A thermal insulating sleeve for a container comprising:

a plurality of side panels defining a generally tubular body positioned about an imaginary longitudinal axis and having an interior wall, an exterior wall, an open first end, a second end, and a bottom forming a central cavity therein for receiving the container; and a plurality of fingers circumferentially positioned along said open first end and generally equally spaced one from another and extending generally radially inwardly into said central cavity;

wherein said fingers each include tab means for urging said fingers outwardly to stabilize the container within said central cavity in spaced relationship from said interior wall.

8. The thermal insulating sleeve of claim 7 wherein said sleeve is formed from a material selected from the group consisting of paperboard, cardboard, box board, plastic, foam, and fabrics.

9. The thermal insulating sleeve of claim 7 wherein said sleeve is formed from an F or E/F paperboard.

10. The thermal insulating sleeve of claim 7 wherein said tubular body includes lithography printed paper effective for outwardly displaying printed matter contained thereon.

11. The thermal insulating sleeve of claim 7 wherein said sleeve has a decahedron cross section.

12. The thermal insulating sleeve of claim 7 wherein said sleeve is formed from an unitary blank.

13. A sleeve for a container comprising:

a tubular body having an interior wall and an exterior wall, an open first end, a second end, and a central cavity therein; and a plurality of flexible fingers positioned about said open first end and extending generally downwardly into said central cavity, said fingers are operable to stabilize a container within said cavity away from said interior wall;

wherein said tubular body is formed from a blank comprising a plurality of adjacent, generally rectangular, side portions connected together, wherein each said side portion has a top end, a bottom end, and a finger extending outwardly from said top end; and an end panel and a flap for connecting and securing together in an overlapping relationship to form said tubular body.

14. The sleeve of claim 13 wherein the sleeve is formed by the steps of:

folding said side portions along longitudinally extending fold lines and securing said end panel and said flap together to form said tubular body; and folding said fingers inwardly into said central cavity.

15. The sleeve of claim 14 wherein the sleeve is further formed by the steps of:

folding a first bottom closure flap inwardly and a second bottom closure flap inwardly such that the upwardly facing surface of said first bottom closure flap is placed into overlapping relation with the downwardly facing surface of said second bottom closure flap and secured thereto to form a bottom.

16. The sleeve of claim 13 wherein said fingers each include a tab means for urging said fingers away from said interior wall.

17. The sleeve of claim 13 wherein said blank is formed from a material selected from the group consisting of paperboard, cardboard, box board, plastic, foam, and fabrics.

18. The sleeve of claim 13 wherein said blank is formed from an F or E/F paperboard.

19. The sleeve of claim 13 wherein said blank includes a lithography printed paper laminate.

20. The sleeve of claim 13 wherein said sleeve includes fold lines for expanding the sleeve into an open configuration for receiving the container and for collapsing the sleeve into a generally planar configuration for periods of non-use.

* * * * *